US005511792A

United States Patent [19]

Simmons et al.

[11] Patent Number: 5,511,792

[45] Date of Patent: Apr. 30, 1996

[54] PIRATE'S TRAP BOARD GAME

[76] Inventors: Dawn M. Simmons, P.O. Box 70; Laurie L. Buchanan, P.O. Box 15, both of, Fidelity, Ill. 62030

[21] Appl. No.: 399,333

[22] Filed: Mar. 6, 1995

[51] Int. Cl.[6] ..... A63F 3/00

[52] U.S. Cl. ..... 273/251; 273/249

[58] Field of Search ..... 273/243, 248, 273/249, 251, 252, 254

[56] References Cited

U.S. PATENT DOCUMENTS

| | | | |
|---|---|---|---|
| 1,656,943 | 1/1928 | Firestone | 273/254 |
| 3,874,671 | 4/1975 | Smith | 273/254 |
| 4,093,235 | 6/1978 | Barry | 273/254 |
| 4,714,255 | 12/1987 | Henry et al. | 273/249 |
| 5,118,113 | 6/1992 | Ahlers | 273/243 |
| 5,273,431 | 12/1993 | Charouhas | 434/129 |
| 5,303,928 | 4/1994 | Scuderi | 273/249 |
| 5,435,566 | 7/1995 | Scuderi | 273/249 X |

*Primary Examiner*—William E. Stoll
*Attorney, Agent, or Firm*—Don W. Weber

[57] ABSTRACT

A pirate's trap board game is presented involving a serpentine pathway between the beginning "Empty Treasures" space and the ending "Open Pirate's Treasure" space. The serpentine pathway is divided into a number of spaces depicting treasure commonly found in a pirate's treasure hunt: a gold bar, an emerald, a sapphire, a treasure chest, a diamond and a pirate. A six-sided die is also utilized to move the player's token, with one face of the die depicting one of the above corresponding figures. When a player rolls a treasure chest he also selects a card from a treasure chest which allows him to advance his token according to the instructions on the card. When a player rolls a pirate, he must pick a card from the pirate's trap cave which instructs him to move his token backward. The game ends when one player rolls a treasure chest and is allowed to advance his token to the open pirate's treasure chest at the end of the serpentine pathway. Colorful sea-faring tokens are also provided to allow the players to remain within the theme of a pirate's treasure hunt.

7 Claims, 2 Drawing Sheets

PIRATE' S TRAP BOARD GAME

BACKGROUND OF THE INVENTION

This invention relates to a board game using dice, tokens, and chance cards. More particularly, it relates to a board game having a serpentine path by which players advance their tokens to recover a pirate's treasure.

Board games are common throughout the United States and the rest of the world. Most board games include a board having a path upon which players advance their tokens, a numbered die which determines the spaces to be moved according to the number thrown, a series of cards to either advance or retard the player's movement, and an object to be reached to win the game.

Games such as the Windsurfing Board Game, disclosed in the 1994 U.S. Pat. No. 5,303,928 issued to Scuderi, contain most of the elements of standard hoard games. However, Scuderi, like most of the board games which have been patented in the United States, all contain various different elements to make that particular game unique and novel. While many board games have the general characteristics of advancing tokens by means of throwing a die until one player wins the game, each board game may contain many different variations so as to create a new and novel game to be played by persons of differing ages.

One problem in using many board games is that they are unsuitable for small children who have not yet learned to count. Since the die used in most games has numbers, which must then be translated into movement of spaces along a pathway, such games may not be suitable for young children who have yet to learn these mathematical skills. It is an object of this invention to provide a game using a die in which the players do not necessarily need to know how to count in numbers in order to play the game.

Many board games have a theme, such as "Windsurfing" in the Scuderi patent described above, or improving the vocabulary such as disclosed in the 1993 U.S. Pat. No. 5,273,431 issued to Charouhas. It is another object of this invention to provide a board game whose main theme is pirates and the searching out of pirate treasure.

It is a further object of this board game to provide a simple yet intriguing pastime by which children or adults may engage in a search for pirate treasure during the course of the board game. Other and further objects of this game will become apparent upon reading the following described Specification.

BRIEF SUMMARY OF THE INVENTION

A pirate's trap board game is presented utilizing a board having a serpentine path along which players move their tokens. The serpentine pathway is divided into a number of small spaces each having a design related to pirate's treasure. Also included on the game board is a pirate's cave in which are placed "pirate's trap" cards. Corresponding to the "pirate's trap" cards are a certain number of spaces designated on the serpentine game board as the "pirate's trap." Also located on the game board is a closed pirate's chest containing "treasure" cards. Corresponding to the closed treasure chest are closed "treasure chest" spaces on the serpentine game board. Pirate's cards generally penalize the players landing on such space, while treasure cards generally reward players landing on the "treasure cards" space.

Players begin at the space marked "Empty Treasures" and alternate throwing the die to advance their tokens. Landing on either the Pirate's Trap or Treasure Chest spaces will retard movement of the token (Pirate's Trap) or advance movement (Treasure Chest) of the token depending on the card drawn. The game is ultimately won when one player reaches the open pirate's treasure chest at the end of the serpentine pattern.

As many players as desired may participate in the board game, with the desired number being at least two and not more than four.

DETAILED DESCRIPTION OF PREFERRED EMBODIMENT

A Pirate's Trap board game is presented. The game is played on a flat board. The game board is laid out as shown in FIG. 1.

Figure 1:
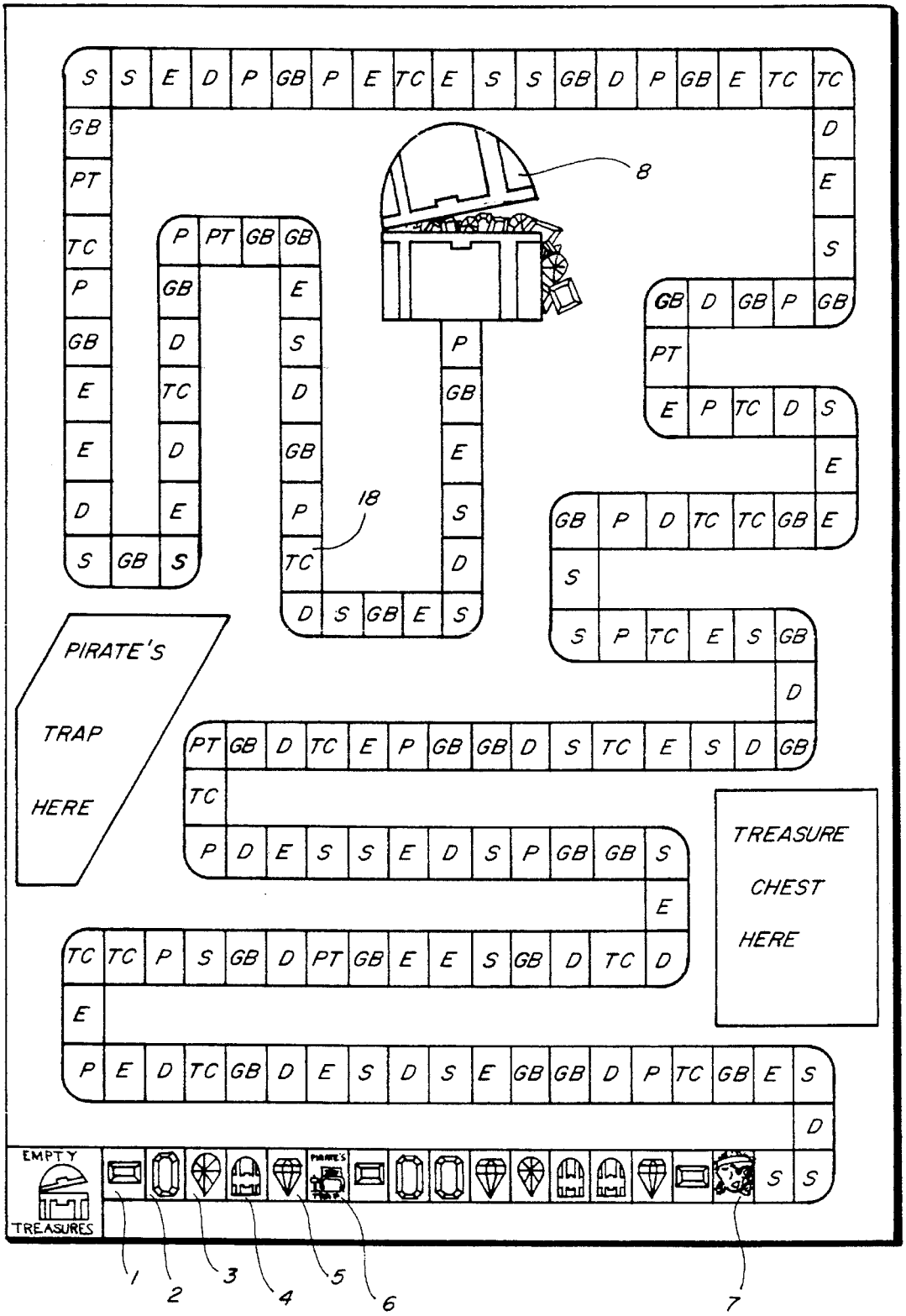
FIG. 1 is a plan view of the game board showing the serpentine path as well as the various spaces designated on the game board. The individual spaces on the serpentine path have been labeled with lettered representations of the individual space designs.

The game board is generally rectangular in shape having a serpentine pattern arranged throughout the board in an irregular path as shown in FIG. 1. The serpentine pattern begins with an expanded space for player's tokens labeled "Empty Treasures." Play begins when a player selects a player's token and places his token on the "Empty Treasures" space.

The individual spaces on the serpentine pathway are designated by means of pictorial illustrations which are generally related to a pirate's treasure. The first space from the "Empty Treasures" space is illustrated with a gold bar 1, shown in FIGS. 1 and 2. The "GB" above the depiction of the gold bar on FIG. 2 denotes that that space has a picture of a gold bar on it. The second space is illustrated with the picture of an emerald, designated as "E" on FIG. 2. The third space has an illustrated sapphire on it, designated as "S" on FIG. 2. The fourth space is illustrated with a treasure chest, "TC", on FIG. 2. The fifth space is illustrated with a diamond figure, denoted as "D" on FIG. 2. The sixth space is a pirate's trap, illustrated by the picture of the pirate's cave, and denoted as "PT" on FIG. 2. The seventh space is illustrated as a pirate and is denoted as "P" on FIG. 2.

Figure 2:
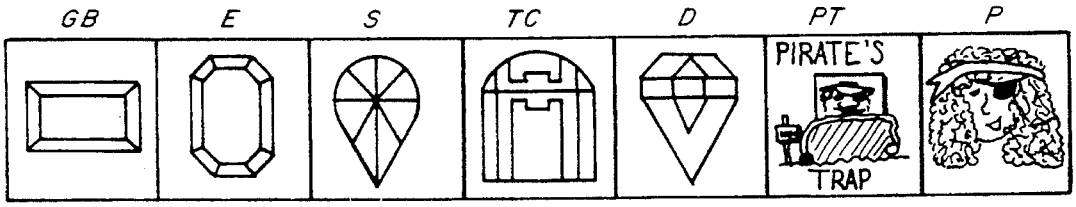
FIG. 2 is an expanded view of the first seven spaces of the game board showing lettered representations of each of the individual designs above that particular design.

For purposes of illustration, each particular drawing figure shown in FIG. 2 and on the first sixteen moving spaces shown on FIG. 1 are actually illustrated in the drawing figures. Spaces 17 through the end of the game, shown on FIG. 1, use the lettered representations set out on FIG. 2. For example, the last space prior to the open pirate's treasure chest 8 is labelled as "P" on Drawing FIG. 1. Therefore the last space illustrated on the actual game board will be that of a pirate 7, designated "P" on FIG. 2. Similarly, Drawing Figures illustrating a gold bar, emerald, sapphire, treasure chest, diamond, pirate's trap and pirate are spaced in the movement spaces indicated in Drawing FIG. 1. It is the intention of this game board to actually depict the various diamonds, chests, traps, and pirates in pictorial form when the full game board is illustrated.

At the end of the serpentine pathway lies the object of the game, the open pirate's treasure chest 8. The object of the game is for the player to advance his token along the serpentine pathway to the open treasure chest 8.

Figure 4:
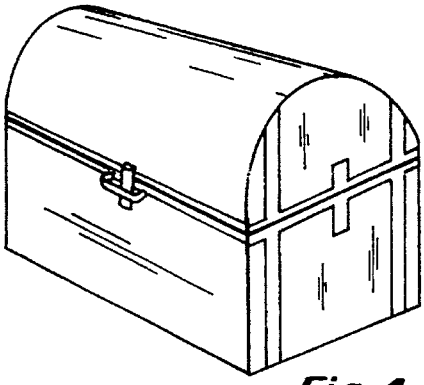
FIG. 4 is a perspective view of the closed treasure chest in which "treasure cards" are placed prior to the beginning of the game. The treasure chest is shaped like a real camel-backed treasure chest.
Figure 5:
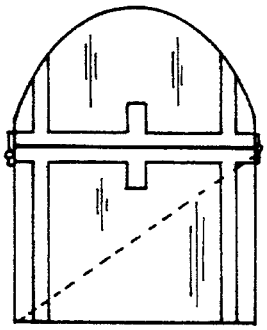
FIG. 5 is an end view of the treasure chest showing (in dotted lines) the platform on which the "treasure cards" are placed.
Figure 11:
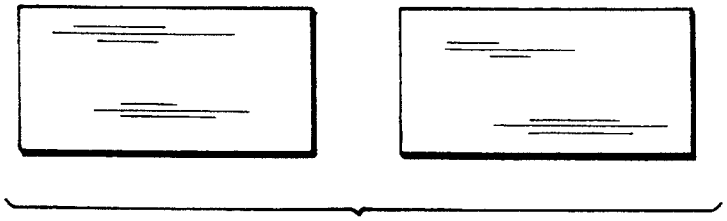
FIG. 11 is a top view of both the "pirate's" and "treasure" cards illustrating their approximate shape.

Also located on the game board, with corresponding illustrations on the die, are "treasure chest" spaces and "pirate" spaces. When a player rolls a "treasure chest", he moves his token to the next space forward illustrating a "treasure chest" and draws a card from the closed pirate's treasure chest 10. This closed pirate's treasure chest 10 is illustrated in FIGS. 4 and 5. The top of the treasure chest opens thus exposing a number of predetermined and shuffled "treasure chest" cards. These "treasure chest" cards, which are the approximate shape shown in FIG. 11, are located face down on the diagonal platform inside the treasure chest 4. (As shown in FIG. 5, the "treasure chest" cards are located on a diagonal platform shown in dotted lines on FIG. 5. In general, the treasure chest cards help the player to advance his token toward the open treasure chest 8. There are 45 "treasure chest" cards, all of which reward the player with advancement of his token. The "treasure chest" cards in the treasure chest, along with the instructions on the cards, are as follows:

5—MOVE AHEAD ONE SAPPHIRE
5—MOVE AHEAD TWO SAPPHIRES
5—MOVE AHEAD ONE EMERALD
5—MOVE AHEAD TWO EMERALDS
5—MOVE AHEAD ONE DIAMOND
5—MOVE AHEAD TWO DIAMONDS
5—MOVE AHEAD ONE GOLD BAR
5—MOVE AHEAD TWO GOLD BARS
5—MOVE TO NEXT TREASURE CHEST AND DRAW AGAIN

When a player lands on the treasure chest, and draws a "treasure chest" card, he advances his token according to the instructions on the cards.

Figure 3:
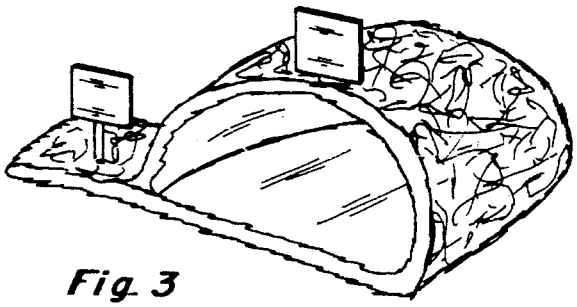
FIG. 3 is a perspective view of the pirate's cave in which "pirate's cards" are placed.

If the player lands on the pirate, that player must then draw a card from the "pirate's trap" cards. The "pirate's trap" cards are also the approximate shape shown in FIG. 11. In general, "pirate's trap" cards penalize a player and instruct him to move his token back toward the start or "Empty Treasures" space on the serpentine board. The "pirate's trap" cards are located in a pirate's cave, as best shown on FIG. 3. FIG. 3 is a perspective view of the pirate's cave and has a hollow cave-like opening. "Pirate's trap" cards are located inside the pirate cave. The 50 "pirate's trap" cards and their instructions, used in playing this game are as follows:

5—MOVE BACK ONE SAPPHIRE
5—MOVE BACK TWO SAPPHIRES
5—MOVE BACK ONE EMERALD
5—MOVE BACK TWO EMERALDS
5—MOVE BACK ONE DIAMOND
5—MOVE BACK TWO DIAMONDS
5—MOVE BACK ONE GOLD BAR
5—MOVE BACK TWO GOLD BARS
5—MOVE BACK TO PIRATE'S TRAP
5—MOVE BACK TO EMPTY TREASURES

When a player rolls a pirate on the die, he moves his token to the next forward pirate and then draws a "pirate's trap" card from the pirate's cave. The player then moves his token backward according to the instructions written on the card.

As shown in FIG. 1, the treasure chest with "treasure" cards is located on the right hand side of the game board while the pirate's cave with "pirate's trap" cards is located on the left side of the game board.

Figure 6:
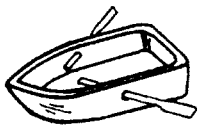
FIG. 6 is a perspective view of one of the player's tokens illustrating the row boat with oars.
Figure 7:
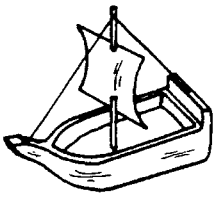
FIG. 7 is a perspective view of a second player's token depicting a pirate's ship with sails.
Figure 8:
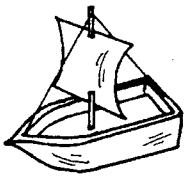
FIG. 8 is a perspective view of a third player's token depicting a sailboat with sails.
Figure 9:
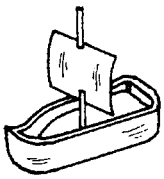
FIG. 9 is a perspective view of a fourth player's token, depicting a Viking ship with a single sail.

Various tokens may be used in playing this game. The tokens provided all relate to the ocean and/or pirates. The tokens are illustrated in FIGS. 6 through 8. FIG. 6 illustrates a pirate's rowboat complete with oars. FIG. 7 is a pirate ship having an upper aft deck and sails. FIG. 8 is a standard sail boat with sails while FIG. 9 shows a Viking ship with a pointed masthead. Each player picks a separate token and places it on the "Empty Treasures" space to begin the game.

The various spaces containing the illustrations described above are placed randomly throughout the serpentine pattern. For example, the Gold Bar 1 (GB) occurs throughout the serpentine pattern, as does the Emerald 2 (E) , the Sapphire 3 (S), the treasure chest 4 (TC), the Diamond 5 (D), the pirate's trap 6 (PT) and the pirate 7 (P).

A cubic game die is also provided for playing this game.

Figure 10:
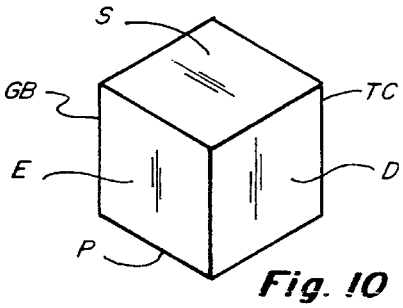
FIG. 10 is a perspective view of the game die, with the designs on each face of the die represented by letters.

Corresponding to the pictorial illustrations of the gold bar, emerald, sapphire, treasure chest, diamond, and pirate, on the game board are illustrations on the six sides of the cubic die. This cubic die is illustrated in FIG. 10. The cubic die 10 has six sides. Each side has one of the illustrations (1 through 5 and 7) placed on it. These six individual illustrations would include a Gold Bar 1, an Emerald 2, a Sapphire 3, a treasure chest 4, a diamond 5, or a pirate 7. Players take turns rolling the die and then moving their tokens to the next advanced space containing the same illustration as is on the die.

PLAYING THE GAME

The object of the game is to reach the open treasure chest. In order to play the game, the following steps are undertaken.

The first step in playing the game is to set up the game board. The "treasure" cards are shuffled and placed face down in the treasure chest. The treasure chest is then placed in its space on the right side of the game board. Next, the "pirate's trap" cards are shuffled and placed face down in the pirate's cave. The pirate's cave is then placed in its proper location on the game board. Next each player will select his colored ship token. These tokens are illustrated in FIGS. 6 through 9. The token is then placed at the "Empty Treasures" space at the beginning of the game.

Each player, in turn, rolls the die. Before a player can begin the passageway along the serpentine path to the open treasures 8 he must roll a gold bar. A player takes his turn until he rolls a gold bar and then advances his token to the first space 1 next to the "Empty Treasures."

After rolling the gold bar, the player's next turn begins his advancement further along the serpentine pathway. When a player rolls the dice, he or she proceeds to the next space corresponding to the illustration of the die rolled. For example, if a player rolls a diamond on his next turn after rolling a gold bar, he proceeds to the fifth space out from the start, corresponding to the diamond. He then awaits his next turn.

If a player rolls a treasure chest, he moves his token to the next treasure chest and draws a "treasure chest" card. The player would then also advance his token according to the instructions written on the treasure chest card, e.g., "move ahead two emeralds" or "move ahead two sapphires."

On the other hand, if the player rolls a pirate, he moves his token to the next pirate and draws a "pirate's trap" card from the pirate's cave 9. The player must then move his token backwards according to the instructions written on the card. If a player draws one of the cards labelled "Move back to pirate's trap" he must move his token back along the serpentine path to the nearest pirate's trap. In order to get out of the pirate's trap, a player must roll a gold bar. When he does, he may advance his token to the next gold bar and await his next turn.

If a player draws a card sending him back to the "Empty Treasures" space, he must roll a gold bar to proceed along the pathway, as at the beginning of the game.

In order to win the game, a player must roll a treasure chest. If a player is on the last treasure chest 18 and draws the card "Move to the next treasure chest and draw again" he or she wins the game instantly. Otherwise the game is won when the player is closer to the open treasure chest than the space denoted 18 and rolls a treasure chest on the die.

The theme of the game is the hunt for pirate's treasure and includes diamonds, emeralds and sapphires as spaces along the serpentine pathway. Players advance their sea-faring tokens along the pathway, taking into account the various good surprises (Treasure Chest spaces) and calamities (Pirate's Trap spaces) which might accompany a real treasure hunt. While the game is designed for children between the ages of 5 and 14, younger children or adults would also find pleasure in playing this game.

While the number and labelling of both the "pirate's trap" and "treasure chest" cards has been described, these numbers and specific instructions on the cards are meant as a means of illustration only and not as a limitation. Obviously, more cards or alternate instructions may be included in this game while still keeping within the spirit of the instant invention. Similarly, while a pirate's theme is disclosed herein, the general method of playing the game involving moving along a serpentine pathway with certain cards and spaces designated as rewards and other cards and spaces designated as penalties is within the spirit and concept of the instant game.

The illustrations shown in FIGS. 1 and 2, and FIGS. 6 through 9, are preferred. However, obviously other illustrations or depictions of game spaces or tokens may be utilized while keeping within the spirit and scope of this invention. Further, the pirate's chest and pirate's cave are meant as a means of illustration only and are within the general theme of this invention. The specific shape of the treasure chest and pirate's cave may also vary while still keeping within the spirit and concept of the disclosure herein.

Having fully described my device, I claim:

1. A board game with a pirate's theme, comprising:

(a) a game board having a serpentine pathway divided into discreet spaces including a starting space, and an ending "open treasure space", wherein said spaces have randomly placed illustrations of various jewels or pirate-related objects;

(b) a cubic die having corresponding illustrations of the various jewels and some of the pirate-related objects on each face;

(c) a Treasure Chest containing "Treasure Chest" cards and corresponding Treasure Chest spaces on said game board;

(d) a pirate's cave containing "pirate's trap" cards and corresponding pirate spaces on said game board;

(e) player's tokens for movement along said serpentine pathway.

2. A board game with a pirate's theme as in claim 1, wherein said "treasure" cards allow the player to advance his token and "pirate's trap" cards instruct the player to move his token backwards.

3. A board game with a pirate's theme as in claim 1, wherein said player's tokens comprise a row boat with oars, a pirate's ship with sails, a sailboat with sails, and a Viking ship.

4. A board game with a pirate's theme as in claim 1, wherein said jewels comprise an emerald, a sapphire, and a diamond and said pirate-related objects comprise a gold bar, a treasure chest, a pirate and a pirate's trap.

5. A board game with a pirate's theme as in claim 1, wherein each of the six faces of said die contains an illustration of one of the following: a gold bar, an emerald, a sapphire, a diamond, a pirate, or a treasure chest.

6. A board game with a pirate's theme as in claim 1, wherein said "treasure chest" is shaped like a real pirate's camel-backed treasure chest.

7. A method of playing a board game having a pirate theme, using the game board, die and cards, set out in claim 1, comprising the steps of:

(a) placing the "treasure" and "pirate's trap" cards in their respective receptacles;

(b) placing said tokens in the starting space;

(c) rolling the die until a player rolls a gold bar and then advancing that player's token to the nearest "gold bar" space;

(d) alternating turns among the players;

(e) moving each player's token to the next advanced space illustration corresponding to the illustration on the die rolled;

further comprising the steps of:

(f) drawing a "treasure" card when a player lands on a "treasure chest" space and advancing that player's token according to the instructions on said card;

(g) drawing a "pirate's trap" card when a player lands on a "pirate" space and moving that player's token backwards according to the instructions on said card;

(h) rolling a "gold bar" to move from a space marked "Empty Treasures" or "Pirate's Trap";

(i) winning the game by advancing a player's token to the space marked "Open Treasures" by either throwing a "treasure chest" on the die or drawing a "treasure" card marked "Move to next treasure chest and draw again" after the player's token has advanced past all "treasure chest" spaces.

* * * * *